US007815437B2

(12) United States Patent
Stegmaier et al.

(10) Patent No.: US 7,815,437 B2
(45) Date of Patent: Oct. 19, 2010

(54) SPOTLIGHT FOR ILLUMINATION IN FILM, STUDIO, EVENT OR THEATRE ENVIRONMENTS

(75) Inventors: Klaus Stegmaier, Viechtach (DE); Michael Jonischkeit, Alxing (DE); Christian Friedinger, Rosenheim (DE); Stefan Schmidt, Forstinning (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 0 days.

(21) Appl. No.: 12/311,762

(22) PCT Filed: Oct. 11, 2007

(86) PCT No.: PCT/EP2007/060837

§ 371 (c)(1),
(2), (4) Date: May 1, 2009

(87) PCT Pub. No.: WO2008/043816

PCT Pub. Date: Apr. 17, 2008

(65) Prior Publication Data

US 2010/0033977 A1 Feb. 11, 2010

(30) Foreign Application Priority Data

Oct. 12, 2006 (DE) ..... 20 2006 016 134 U
Nov. 3, 2006 (DE) ..... 20 2006 017 131 U

(51) Int. Cl.
*H01R 39/00* (2006.01)
*H01R 35/00* (2006.01)

(52) U.S. Cl. ..... 439/13; 439/534

(58) Field of Classification Search ..... 439/13, 439/14, 332, 335, 534; 362/454, 455, 410, 362/382

See application file for complete search history.

(56) References Cited

U.S. PATENT DOCUMENTS 5,493,484 A * 2/1996 Osteen et al. ..... 362/410
6,200,011 B1 * 3/2001 Miller et al. ..... 362/554

(Continued)

FOREIGN PATENT DOCUMENTS

DE 762 492 7/1954

(Continued)

OTHER PUBLICATIONS

International Search Report dated Feb. 18, 2008 for corresponding PCT/EP2007/060837.

(Continued)

*Primary Examiner*—Chandrika Prasad
(74) *Attorney, Agent, or Firm*—Christie, Parker & Hale, LLP

(57) ABSTRACT

A spotlight for illumination in film, studio, event or theatre environments, with an electrical terminal for connecting the spotlight to a supply line for supplying electricity to the spotlight, is provided. The electrical terminal is rotatably mounted on the spotlight and can be matched in terms of its alignment, so as to connect the spotlight to the supply line. The position of the electrical terminal can be matched in dependence on the arrangement of the spotlight, in order to supply the electric supply line to the spotlight from different directions.

24 Claims, 10 Drawing Sheets

U.S. PATENT DOCUMENTS

| | | | | |
|---|---|---|---|---|
| 2004/0170023 | A1 | 9/2004 | Stegmaier | |
| 2005/0148241 | A1 | 7/2005 | Kohen | |
| 2009/0246976 | A1 * | 10/2009 | Niitsu et al. | 439/13 |

FOREIGN PATENT DOCUMENTS

| | | | |
|---|---|---|---|
| DE | 80 08 422 | U1 | 7/1980 |
| DE | 201 07 299 | U1 | 8/2001 |
| DE | 101 31 497 | A1 | 1/2003 |
| DE | 20 2005 013 244 | U1 | 12/2005 |
| EP | 1 133 025 | A2 | 9/2001 |
| WO | WO 2007/020108 | A1 | 2/2007 |

OTHER PUBLICATIONS

Search Report for German Patent Application No. 20 2006 017 131.2, dated Apr. 7, 2010, 4 pages.

* cited by examiner

SPOTLIGHT FOR ILLUMINATION IN FILM, STUDIO, EVENT OR THEATRE ENVIRONMENTS

CROSS-REFERENCE TO A RELATED APPLICATION

This application is a National Phase Patent Application of International Patent Application Number PCT/EP2007/060837, filed on Oct. 11, 2007, which claims priority of German Utility Model Application Number 20 2006 016 134.1, filed on Oct. 12, 2006 and of German Utility Model Application Number 20 2006 017 131.2, filed on Nov. 3, 2006.

BACKGROUND

This invention relates to a spotlight for illumination in film, studio, event and theatre environments.

From DE 201 07 299 U1, a spotlight is known, which includes a spotlight housing with a front part, a middle part and a rear part for accommodating light-generating and light-forming components, in particular a lamp arranged in a lamp holder, a reflector and an ignitor of the spotlight. In the front part of the spotlight housing a light outlet opening is integrated, which is surrounded by a front ring with a lens mount for accommodating one or more lenses. On the middle part of the spotlight housing a stirrup is disposed, by means of which the spotlight can be mounted either standing on a stand or hanging on a rig.

For supplying electricity to the components of the spotlight, such spotlights include, as is for instance known from DE 20 2005 013 244 U1, an electrical terminal which generally is disposed in a lower region of the housing, which represents a function housing for accommodating functional elements of the spotlight and by which a supply line is connected to the spotlight. Proceeding from the electrical terminal, the supply line is routed to the stand or to the rig, on or to which the spotlight is mounted, and is connected to a supply means, for instance a voltage source.

From US 2005/0148241 A1 an electric plug-in connection is known, comprising a connector and a connector receptacle which can be connected with each other in different positions rotated with respect to each other. In the condition plugged in, the connector and the connector receptacle are firmly connected with each other, but can be released and again be plugged into each other in different, rotated positions. The plug-in connection of US 2005/0148241 A1 is usable for small electric appliances and serves both as mechanical stand and as electrical terminal.

SUMMARY

It is the object underlying the invention to provide a spotlight as mentioned above, whose handling is simplified, which can be operated in different positions on a stand or on a rig, and which is configurable and versatile.

In a spotlight for illumination in film, studio or theatre environments, which includes an electrical terminal for connecting the spotlight to a supply line for supplying electricity to the spotlight, it is provided in accordance with an exemplary embodiment of the invention that the electrical terminal is rotatably arranged on the spotlight and can be matched in terms of its alignment so as to connect the spotlight to the supply line, wherein the position of the electrical terminal can be matched in dependence on the arrangement of the spotlight, in order to supply the electric supply line to the spotlight from different directions.

The invention proceeds from the basic idea to arrange the electrical terminal for supplying electricity to the spotlight not firmly on the spotlight, but to form the same such that the electrical terminal can rotatingly be aligned in dependence on the arrangement, erection and attachment of the spotlight, in order to provide for a rather advantageous routing of the supply line away from the spotlight.

The electrical terminal can be arranged on a spotlight housing, in particular the wall of a function housing of the spotlight housing, which contains functional elements of the spotlight, in such a way that it can rotatably be aligned about an axis of rotation, which is directed vertical to the surface of the wall of the function housing carrying the electrical terminal, parallel to the wall of the function housing.

Exemplary, the electrical terminal can be aligned in a first direction for attachment of the spotlight to a stand, and the electrical terminal can be aligned in a second direction different from the first direction for attachment of the spotlight to a rig. This is advantageous in particular in the case of a variable mounting of the spotlight hanging on a rig or standing on a stand, in which the supply line is routed upwards or downwards away from the spotlight in dependence on the mounting of the spotlight, in order to achieve a rather comfortable routing of the supply line, which does not disturb the operation and the handling of the spotlight.

In this connection, it is conceivable to provide a continuous adjustability of the electrical terminal or certain discrete positions of adjustment, which are matched for instance to the position of the stand and the position of the rig.

Exemplary, the electrical terminal can be fixed in its aligned position on the spotlight by means of a latching, clamp or screw connection. It is conceivable, for instance, to clampingly fix the electrical terminal on the wall of the function housing in terms of its alignment and position by means of a clamp connection such that the electrical terminal is retained on the wall and the supply line is routed away from the spotlight in a particular direction. For this purpose, a curved oblong hole or a plurality of mounting points can for instance be provided on the spotlight as receptacle for a screw connection for fixing the electrical terminal in different positions, through which the screw connection extends for making a clamp connection, and which provide for different positions of adjustment of the electrical terminal.

The electrical terminal exemplary includes an electric connector, which is connected with the supply line, and a connector receptacle which is arranged on the spotlight housing, wherein the electric connector can be plugged into the connector receptacle in a plug-in direction for connection of the supply line.

In an exemplary aspect, the connector receptacle is rotatably mounted on the spotlight housing for alignment of the electrical terminal. For making the electric connection, the connector is plugged into the connector receptacle, rotated in the desired way and aligned together with the connector, and subsequently fixed on the spotlight housing. For instance, it is conceivable and advantageous to clampingly press in the wall holding the connector receptacle between the connector receptacle and the connector by means of a latching or screw connection for fixation, so as to lock the electrical terminal relative to the wall.

By means of a mechanical coding of the connector and the connector receptacle, a reverse polarity protection is effected, so that electric short circuits can be excluded in the case of a different alignment of the connector. By means of the reverse polarity protection it is ensured that the connector can be plugged into the connector receptacle merely in one alignment, and plug-in of the connector in a rotated position is prevented. One aspect of the electric reverse polarity protection consists in providing elevations and indentations, in particular in the form of hexagons, in the connector receptacle and in the connector, so that a plug-in connection only is possible with the admissible alignment of connector and connector receptacle, i.e. the connector can only be plugged into the connector receptacle in a particular alignment. The regions for the mechanical coding and the electric connection of the connector with the connector receptacle can selectively be arranged physically separate or overlappingly.

For alignment of the electrical terminal, it is also conceivable to form the connector and the connector receptacle such that the electric connector can be plugged into the connector receptacle in different positions rotated about the plug-in direction, so that proceeding from the connector the supply line connected to the electric connector can point in different directions depending on the plug-in position of the electrical terminal. In this case, the connector receptacle is firmly arranged on the spotlight housing. For making the connection, the connector is aligned in the desired way and plugged into the connector receptacle. A subsequent fixation of the electrical terminal on the spotlight housing then is not required. However, the contacts of the connector and of the connector receptacle must be formed redundantly for forming different plug-in positions.

Exemplary, the electrical terminal includes a safety switching device, which only enables the electrical terminal when the connector is connected with the connector receptacle. The safety switching device can be designed such that, when the connector is not plugged into the connector receptacle, no voltage is applied to the contacts of the connector and/or the contacts of the connector receptacle are not connected with the spotlight components to be supplied.

In an exemplary aspect, the spotlight housing of the spotlight includes a front part, a middle part and a rear part for accommodating light-generating and light-forming components of the spotlight, wherein the spotlight housing is of the modular type. The front part, the middle part and the rear part are connected with each other by at least one connecting means acting in axial direction of the spotlight and can be demounted by releasing the connecting means for configuration of the spotlight. In this way a spotlight is created, which due to the modular type of spotlight housing can be configured for different applications, and whose spotlight housing can be matched to the respective application. With such a spotlight it is possible in particular to vary the design of the spotlight by replacing individual components, in particular light-generating and light-forming components, wherein the use of a front part, middle part and/or rear part of the spotlight housing each matched to the components of the spotlight provides for a compact construction of the spotlight in every configuration.

For a simple connection of the front part, middle part and rear part, axially aligned screw connections preferably are used. In particular proceeding from the rear part, these axially aligned screw connections can engage through the middle part into the front part and in this way create a firm connection between rear part, middle part and front part, which for disassembling the spotlight can easily be released. It is also conceivable to provide separate screw connections between rear part and middle part and between front part and middle part, which can be released independent of each other.

For accommodating the screw connections, self-cutting threads can be provided in the middle part, so as to make a firm connection between rear part and middle part and between middle part and front part.

Exemplary, the front part and the rear part of the spotlight housing constitute aluminum castings, and the middle part of the spotlight housing constitutes an aluminum extruded section. In this way, a front part, a middle part and a rear part are created, which can be manufactured at low cost and satisfy the stability requirements of the spotlight housing. The use of other materials, for instance plastics, for manufacturing the parts of the spotlight housing likewise is conceivable, as far as the materials satisfy the requirements as regards the mechanical and thermal loads of the spotlight housing.

The spotlight of the invention can be configured by releasing the connecting means and by replacing components of the spotlight and parts of the housing. By replacing the middle part, it is in particular possible to create a spotlight housing which is matched in terms of size and shape to the light-generating and light-forming elements enclosed in the spotlight housing and thus is suitable for different configurations of the spotlight.

For accommodating light-generating and light-forming elements, the spotlight housing is formed by the front part, the middle part and the rear part in accordance with the invention. The spotlight housing can form two partial housings, with an upper lamp housing serving to accommodate a lamp and a reflector and a lower function housing serving to accommodate functional elements of the spotlight, for instance a lamp socket, a socket carrier, a focus or sliding spindle and possibly an ignitor, wherein the electrical terminal is arranged in the vicinity of the lower function housing for supplying electricity to the spotlight, and between the lower function housing and the lamp housing an electrical connection exists for supplying electricity to the electric components enclosed in the lamp housing. The electrical connection including a connector receptacle and a connector is of the releasable type, so that the supply line can be separated from the function housing.

It is conceivable that the upper lamp housing and the lower function housing form a unit and are enclosed by a one-piece middle part of the spotlight housing and by the front part and the rear part. It is, however, also conceivable that the upper lamp housing and the lower function housing constitute modular, separate housing parts, wherein the middle part in this case is of the two-piece type and the spotlight housing includes an upper and a lower housing part, which are separable. The connection of the two housing parts of the spotlight housing, which form a function housing and a lamp housing, then can be made for instance by an integral front and rear part each, which act as connecting elements on the end faces of the housing parts. It is likewise conceivable that a plug-in connection is provided between the housing parts, by means of which both a mechanical and an electrical connection can be made between the function housing and the lamp housing.

In a spotlight housing divided into a lamp housing and a function housing it is advantageous to form the front part and the rear part in one piece, in order to make a connection of the spotlight housing by means of the front part and the rear part. In this case, in particular, the front part and the rear part enclose the middle part such that the middle part and hence the upper lamp housing and the lower function housing are firmly connected with each other by the respectively one-piece front and rear parts and the axially acting connecting means.

It is also conceivable to form the front part and/or the rear part in two pieces, in order to achieve a completely modular construction of the spotlight. In this case, an upper and a lower region of the front part and of the rear part can be connected with each other by a screw or plug-in connection or the like.

Advantageously, the lamp housing and the function housing are formed separate from each other such that the lamp housing and the function housing can be replaced independently. The electrical terminal on the function housing can be released for this purpose, in order to separate the supply line from the function housing and connect the same with the new function housing. In particular, the modular design of the spotlight allows matching of the spotlight for operation with light-generating and light-forming components of different electric power, wherein the most compact spotlight construction possible is achieved by matching the spotlight housing to the respectively used components.

BRIEF DESCRIPTION OF THE DRAWINGS

The basic idea of the invention will be explained in detail in the following Figures with reference to several embodiments. In the figures.

DETAILED DESCRIPTION

Figure 1:
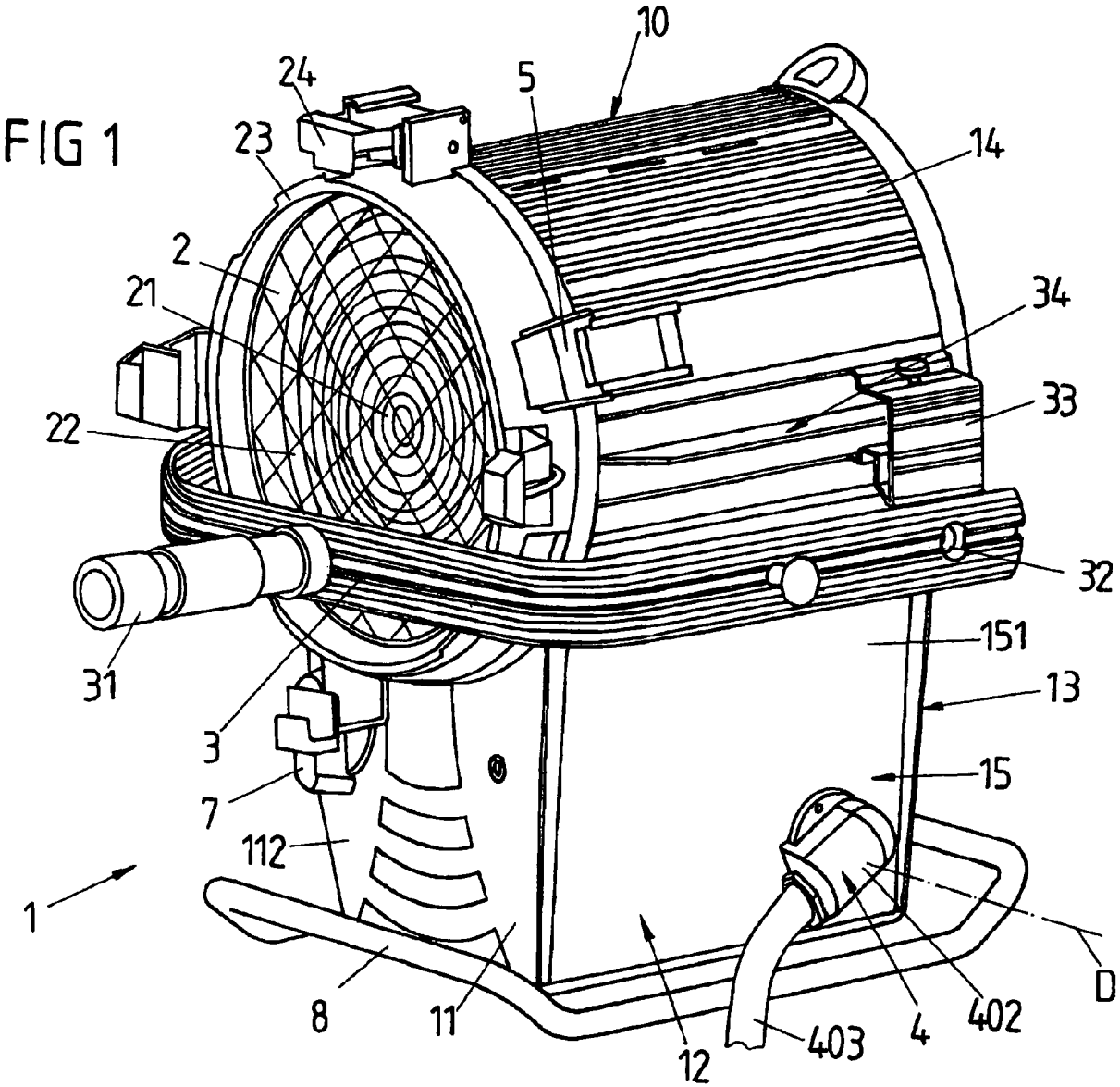
FIG. 1 shows a perspective view of a spotlight obliquely from the front.
Figure 2:
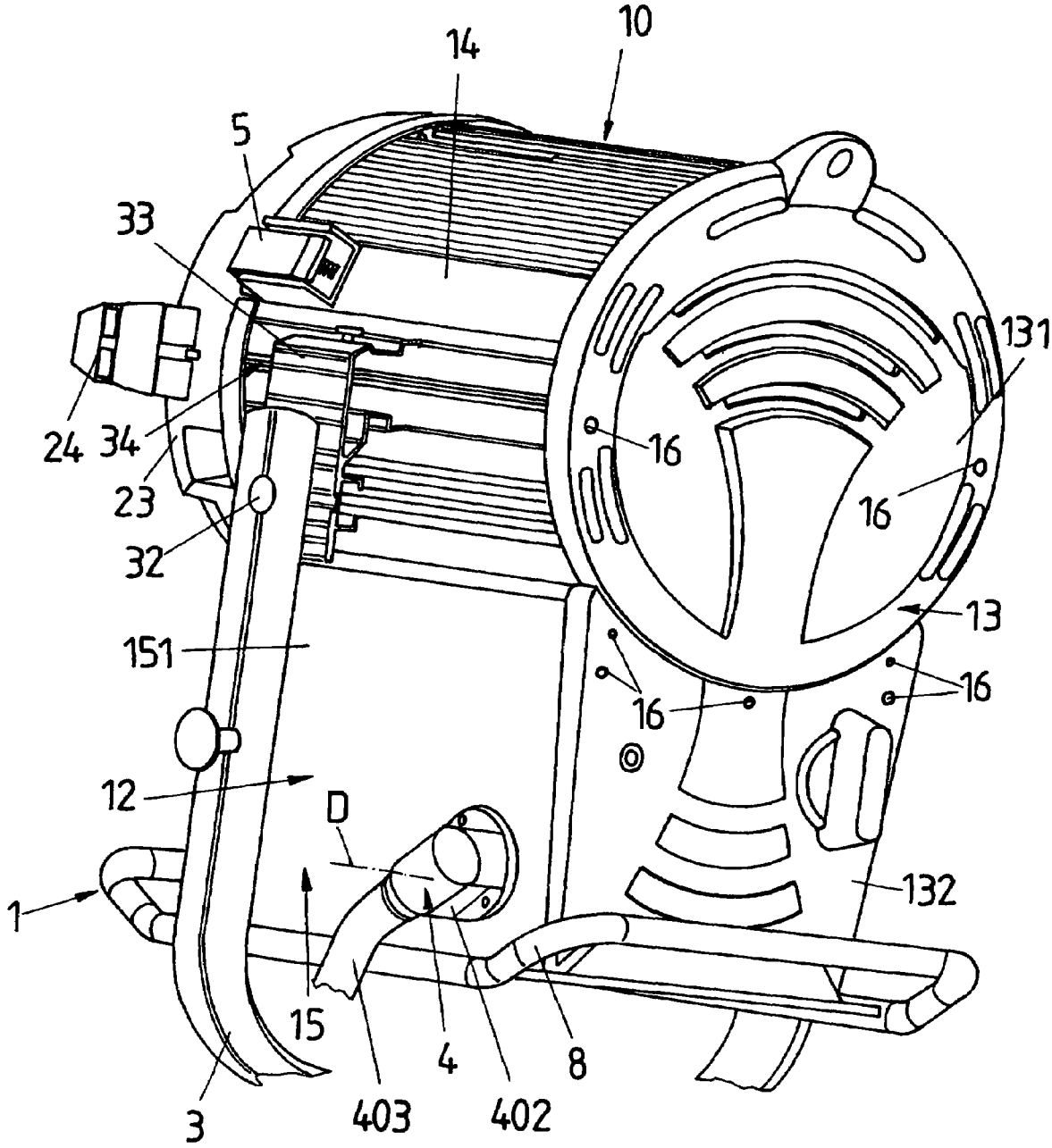
FIG. 2 shows a perspective view of the spotlight of FIG. 1 obliquely from behind.
Figure 3:
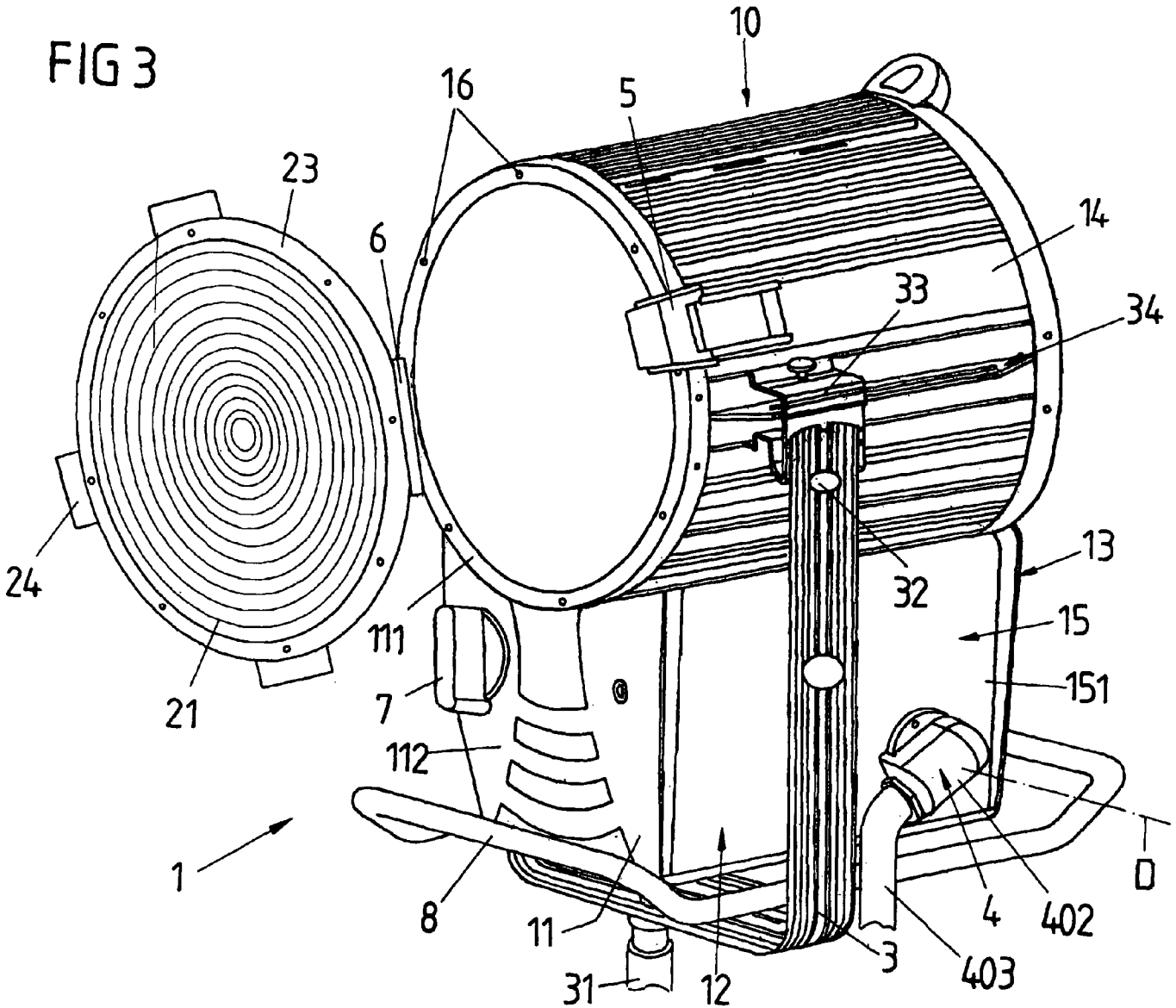
FIG. 3 shows a perspective view of the spotlight of FIG. 1 with the lens mount folded down.

FIGS. 1 to 3 show a spotlight 1 with a spotlight housing 10 which comprises an upper lamp housing 14 and a lower function housing 15, which are of the modular type and are replaceable for configuring the spotlight 1 and for matching the spotlight 1 for different applications. The function housing 15 enclosed in a floor pan, which contains functional elements of the spotlight 1, for instance a lamp socket, a socket carrier, a focus or sliding spindle or possibly an ignitor, and the lamp housing 14 enclosed in a cylindrical aluminum extruded section, in which light-generating and light-forming components of the spotlight 1, such as a lamp and a reflector, are arranged, each form modular units of the spotlight housing 10, which are releasable from each other and together form a middle part 12 of the spotlight 1.

To the front, the middle part 12 is defined by a front part 11, which in its lower region includes a trapezoidal face part 112 of the floor pan enclosing the function housing 15 and in its upper region, as is shown in particular in FIG. 3, includes an annular upper part 111, which defines the cylindrical upper lamp housing 14 to the front. The front part 11 is of the one-piece type, wherein the lower trapezoidal part 112 of the front part 11 is integrally connected with the upper annular part 111 of the front part 11 and thus represents an integral connecting element for the lamp housing 14 and the function housing 15. It is also conceivable to form the front part 11 in two pieces with separate upper and lower parts 111, 112.

The rear part 13 of the spotlight housing 10, as can be taken in particular from FIG. 2, forms the rearward end of the middle part 12 of the spotlight housing 10, which comprises the lamp housing 14 and the function housing 15, and like the front part 11 comprises a lower trapezoidal part 132, which defines the floor pan of the function housing 15 to the rear, and an upper, closed circular part 131, which forms the rearward end of the lamp housing 14.

The upper part 111 of the front part 11 of the spotlight housing 10 is of the annular type and forms a light outlet opening 2. As shown in FIG. 1, a lens mount 23 defining the light outlet opening 2 in radial direction is arranged before the front part 11, which lens mount carries a lens 21 arranged before the light outlet opening 2 for forming the emerging light beams and carries a wire guard 22. On the lens mount 23, mounting brackets 24 are provided for accommodating accessories, such as diffusers, color film filters or barndoors. The lens mount 23 can be folded down, wherein the connection of the lens mount 23 with the spotlight housing 10 is effected by a latchable or lockable connecting means, which consists of a hinge 6 (see FIG. 3), in which the lens mount can be hooked in, and of a catch mechanism 5. The catch mechanism 5 includes a catch hook which engages the lens mount 23 and thus makes a connection between the spotlight housing 10 and the lens mount 23. For folding down the lens mount 23, the catch hook of the catch mechanism can be disengaged, and the lens mount 23 can be swiveled about the hinge 6. In FIG. 3, the lens mount 23 is shown in a position folded down from the front part 11 of the spotlight housing 10, in which the lens 21 held by the lens mount 23 can be replaced or can be engaged into the interior of the spotlight 1.

On the front part 11, a focus knob 7 is arranged, which can rotatingly be actuated for changing the light opening angle of the spotlight 1.

On the middle part 12 of the spotlight housing 10, a stirrup 3 is movably mounted, which in the position shown in FIG. 1 is horizontally aligned to the front and in FIGS. 2 and 3 vertically downwards. The stirrup 3 is pivotally mounted on a sliding element 33 via a pivot point 32, wherein for matching the position of the stirrup 3 the sliding element 33 can be shifted along a guideway 34 on the spotlight housing 10. The attachment of the stirrup 3 to the spotlight housing 10 can be varied in terms of position and alignment, so that by means of the stirrup 3 the spotlight 1 can be attached both to a stand and to a rig. The stirrup has a U-shaped form, encloses the spotlight 1 proceeding from its pivot point 32 on the sliding element 33 and, as shown in FIGS. 2 and 3, is aligned downwards for mounting the spotlight 1 on a stand, and by means of a fastening bolt 31, which is arranged centrally on the transversal portion of the U-shaped stirrup 3, can be connected with a stand, which for this purpose includes a receptacle for latchingly mounting the fastening bolt 31. For mounting the spotlight 1 hanging on a rig, the stirrup 3 is swiveled by 180° about its pivot point 32, so that proceeding from the middle part 12 the stirrup 3 points upwards and can be brought in engagement with a corresponding receptacle on the rig via the fastening bolt 31.

On the bottom surface of the function housing 15, a stirrup-like handle 8 is arranged for carrying and handling the spotlight 1.

The spotlight housing 10 consisting of front part 11, middle part 12 and rear part 13 is of the modular type. The front part 11 and the rear part 13 are made of aluminum castings, wherein the front part 11 and the rear part 13 each can be formed in one piece or in two pieces. In its upper, cylindrically shaped region comprising the lamp housing 14, the middle part 12 divided into the lamp housing 14 and the function housing 15 is made of an aluminum extruded section, and in its lower region forming the function housing 15 it is made of a pan-like bent aluminum part.

The representation of the spotlight 1 shown in FIG. 2 obliquely from behind shows the rear part 13 of the spotlight housing 10 connected with the middle part 12 of the spotlight housing 10, which can be formed in one piece or in two pieces with separate upper and lower parts 131, 132, wherein in the two-piece configuration a connection between the upper part 131 and the lower part 132 is made for instance by a plug-in or screw connection.

The connection between the rear part 13, the middle part 12 and the front part 11 is effected by axial screw connections 16, which are distributed along the upper part 131 and the lower part 132 of the rear part 13 and engage through the middle part 12 into the front part 11 or vice versa proceeding from the front part 11 through the middle part 12 into the rear part 13. For demounting the spotlight 1, the screw connections 16 can be released, whereby the connection between front part 11, middle part 12 and rear part 13 can be undone and the spotlight housing 10 can be disassembled into its individual parts 11, 12, 13, and the lamp housing 14 and/or the function housing 15 can be replaced.

To configure the spotlight 1 as shown in FIG. 1 to FIG. 3, the axial screw connections 16 on the rear part 13 of the spotlight housing 10 are released, and rear part 13, middle part 12 and front part 11 are separated from each other. The two-piece middle part 12 consisting of the function housing 15 and the lamp housing 14 then can be dismantled, so that the lamp housing 14 and/or the function housing 15 can be replaced together with the light-generating or light-forming components enclosed by the lamp housing 14 and the function housing 15. In this way, it is possible to combine different lamp housings 14 with different function housings 15, so that the spotlight 1 can separately be configured for each application.

On the middle part 12 of the spotlight housing 10, an electrical terminal 4 is provided on a wall 151 of the function housing 15, by means of which the spotlight 1 can be connected with a supply line 403. The electrical terminal 4 is provided in the form of an angular connector describing an angle of 90°, which, as will be explained in detail below, includes a connector receptacle arranged on the wall 151 and a connector, which for making the electrical connection can pluggably be inserted into each other vertical to the surface of the wall 151.

In FIGS. 1 to 3, only the connector 402 of the electrical terminal 4 can be seen, which, as shown in FIGS. 1 to 3, is plugged into the connector receptacle on the wall 151 in the connected condition. The connector 402 is connected with the supply line 403, which extends from the connector 402 parallel to the surface of the wall 151.

The electrical terminal 4 is rotatably arranged on the wall 151 of the function housing 15 about an axis of rotation D, and, for instance in dependence on the spotlight 1 being mounted standing on a stand or hanging on a rig, can be varied in its alignment about the axis of rotation D for an optimum routing of the supply line 403. The axis of rotation D extends vertical to the surface of the wall 151 of the function housing 15 on which the electrical terminal 4 is arranged, so that the alignment of the electrical terminal 4 about the axis of rotation D can be matched parallel to the surface of the wall 151 of the function housing 15.

In the position shown in FIGS. 2 and 3, the electrical terminal 4 is located in a stand setting in which the supply line 403 extending from the electrical terminal 4 obliquely points towards the bottom surface of the spotlight housing 10, so that when mounting the spotlight 1 upright on a stand by means of the stirrup 3—i.e. in a position in which the bottom surface of the function housing 15 of the spotlight 1 points towards the stand—the supply line 403 is routed from the electrical terminal 4 towards the stand.

When mounting the spotlight 1 in a hanging position on a rig, the stirrup 3 is swiveled by 180° and is connectable with the rig via the fastening bolt 31. To achieve a rather advantageous routing of the supply line 403, the electrical terminal 4 can be rotated, so that in one rig setting, the supply line 403 points from the electrical terminal 4 upwards in the direction of the rig.

Figure 4A:
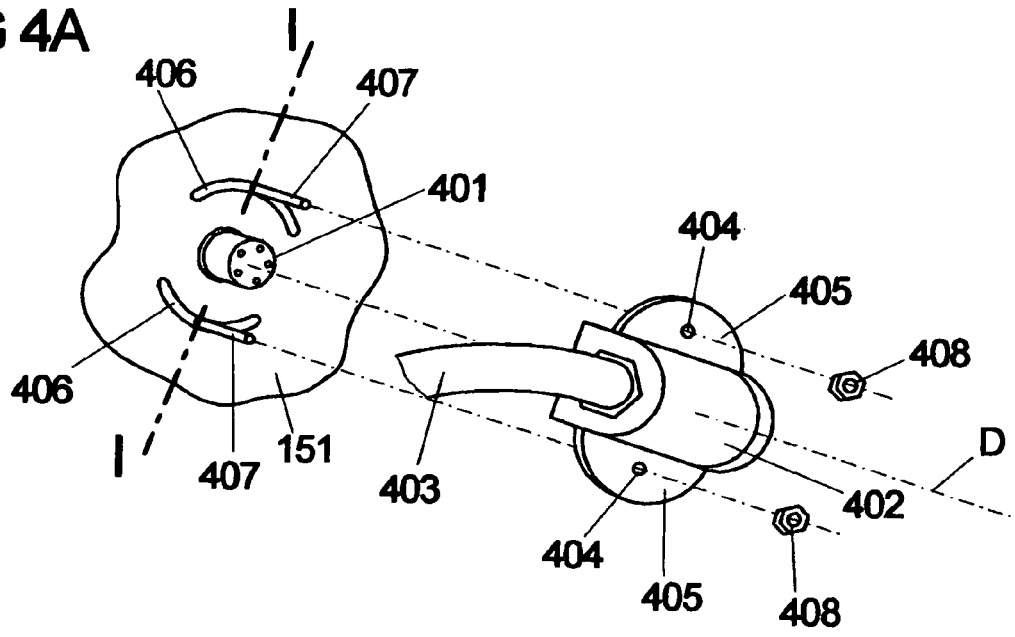
FIG. 4A shows an exploded view of a first embodiment of the electrical terminal with an oblong hole on the spotlight for the alignable attachment of the electrical terminal.
Figure 4B:
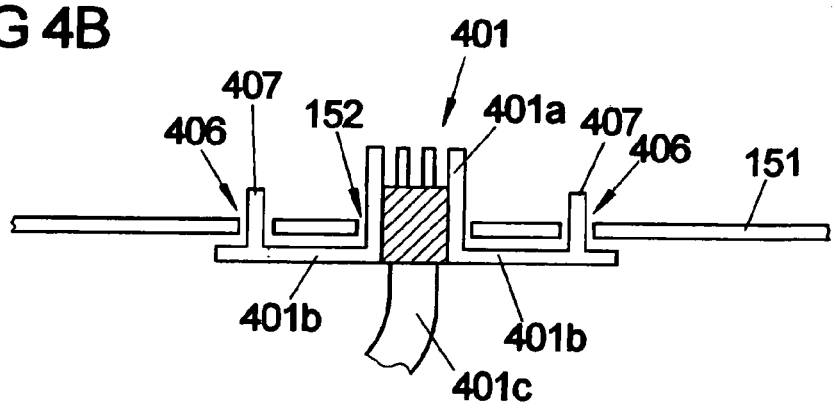
FIG. 4B shows a cross-sectional view through the electrical terminal along line I-I of FIG. 4A.
Figure 4C:
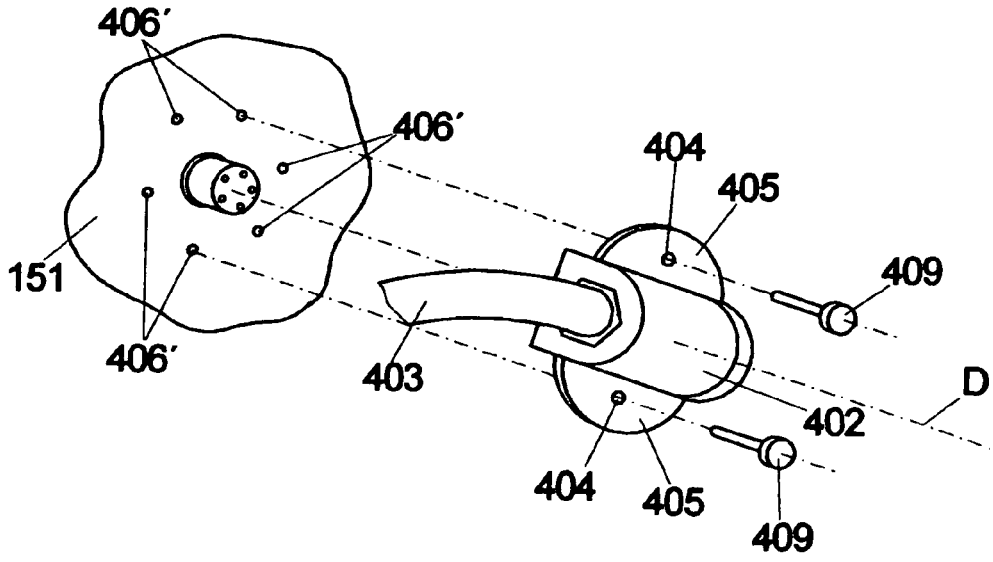
FIG. 4C shows an exploded view of a second embodiment of the electrical terminal with individual mounting points on the spotlight for the alignable attachment of the electrical terminal.

In FIGS. 4A to 4C, different aspects of a rotatable arrangement of the electrical terminal 4 on the spotlight 1 are shown.

FIG. 4A shows the electrical terminal 4 on the wall 151 of the function housing 15 in a schematic exploded view. The electrical terminal 4 includes a connector 402, which is connected with the supply line 403 and for making the electrical connection can be plugged into a connector receptacle 401, which is rotatably arranged on the wall 151 of the function housing 15. FIG. 4A shows the connector 402 and the connector receptacle 401 before making the connection.

In FIG. 4B, the arrangement of the connector receptacle 401 on the wall 151 of the function housing 15 is shown in a cross-sectional view along line I-I of FIG. 4A. As can be taken from FIG. 4B, the connector receptacle 401 extends through an opening 152 in the wall 151 of the function housing 15, and with a bearing plate 401*b* arranged on a receptacle housing of the connector receptacle 401 rests against the wall 151 on the rear in the vicinity of a rim of the opening 152. On the rear, the connector receptacle is connected with a lead 401*c*, which extends from the connector receptacle 401 to the functional elements enclosed in the function housing 15 and to other components of the spotlight 1 to be supplied with electricity, and completes the electrical connection between the supply line 403 and the functional elements and the other components. The bearing plate 401*b* effects that the connector receptacle 401 plugged into the opening 152 of the wall 151 on the rear cannot slide through the opening 152, and surrounds the receptacle housing 401*a* either annularly or in the form of individually formed webs.

In the wall 151 of the function housing 15 two curved oblong holes 406 are provided, which are arranged symmetrically about the connector receptacle 401 and are formed to receive screw or bolt connections 407, 408. In the mounted condition, the screw or bolt connections 407, 408 extend through the oblong holes 406 and openings 404 arranged symmetrically opposite each other in flanges 405 on the connector 402 and clampingly fix the electrical terminal 4 to the wall 151. The oblong holes allow the electrical terminal 4 to be rotated about the axis of rotation D and to be aligned in different directions and be fixed to the wall 151.

Different configurations of the screw or bolt connection for fixing the electrical terminal 4 to the wall 151 are conceivable. As shown in FIGS. 4A and 4B, it is conceivable for instance to form bolts 407 on the bearing plate 401*b* of the connector receptacle 401, which extend vertical to the bearing plate 401*b* and extend through the oblong holes 406. In the mounted condition, the bolts 407 extend through the oblong holes 406 and the openings 404 in the connector 402 and are screwed with nuts 408 such that the connector 402 and the connector receptacle 401 are pressed against the wall 151 and the electrical terminal 4 is clampingly fixed on the wall 151.

It is also conceivable to provide threaded receptacles in the bearing plate 401*b*, in which engage screws extending through the openings 404 in the connector 402 and through the oblong holes 406, which screws connect the connector 402 with the connector receptacle 401 and clampingly fix the electrical terminal 4 on the wall 151.

For making the electrical connection between the supply line 403 and the spotlight 1, the connector 402 is plugged into the connector receptacle 401. At the same time, the bolts 407 connected with the connector receptacle 401 are passed through the oblong holes 406 and the openings 404 and fixed by means of one nut 408 each to be screwed onto the bolts 407 such that the wall 151 is clamped between the bearing plate 401*b* of the connector receptacle 401 and the flanges 405 of the connector 402, and the electrical terminal 4 is clampingly fixed and retained in its position on the wall 151.

If threaded receptacles are provided in the bearing plate 401*b* instead of the bolts 407, screws are inserted through the openings 404 of the connector 402 into the threaded receptacles in the bearing plate 401*b* and tightened upon plugging the connector 402 into the connector receptacle 401, in order to clampingly fix the electrical terminal 4 on the wall 151.

For newly aligning the electrical terminal 4, the connection is released, the electrical terminal 4 is rotated and the connection is tightened again, so that the electrical terminal 4 in turn is clampingly retained on the wall 151.

In an alternative aspect shown in FIG. 4C, six individually formed mounting points 406' are formed in the wall 151 instead of the oblong holes 406, which define different positions of the electrical terminal 4 relative to the wall 151. For assembly, screws 409 are passed through the openings 404 in the connector 402 and through two opposed mounting points 406' each and screwed into threaded receptacles in the bearing plate 401*b* of the connector receptacle 401. The screws 409 connect the connector 402 with the connector receptacle 401 and clamp the wall 151 between the flanges 405 of the connector 402 and the bearing plate 401*b* of the connector receptacle 401, in order to clampingly fix the electrical terminal 4 on the wall 151.

In FIG. 4C, six mounting points 406' are shown, which define six different positions of the electrical terminal 4 each rotated relative to each other by 60° about the axis of rotation D. A different number of mounting points 406' (for instance 4 or 8) is of course also conceivable, wherein it is essential that two mounting points 406' each are symmetrically arranged opposite each other in the wall 151 in the vicinity of the connector receptacle 401.

Figure 5:
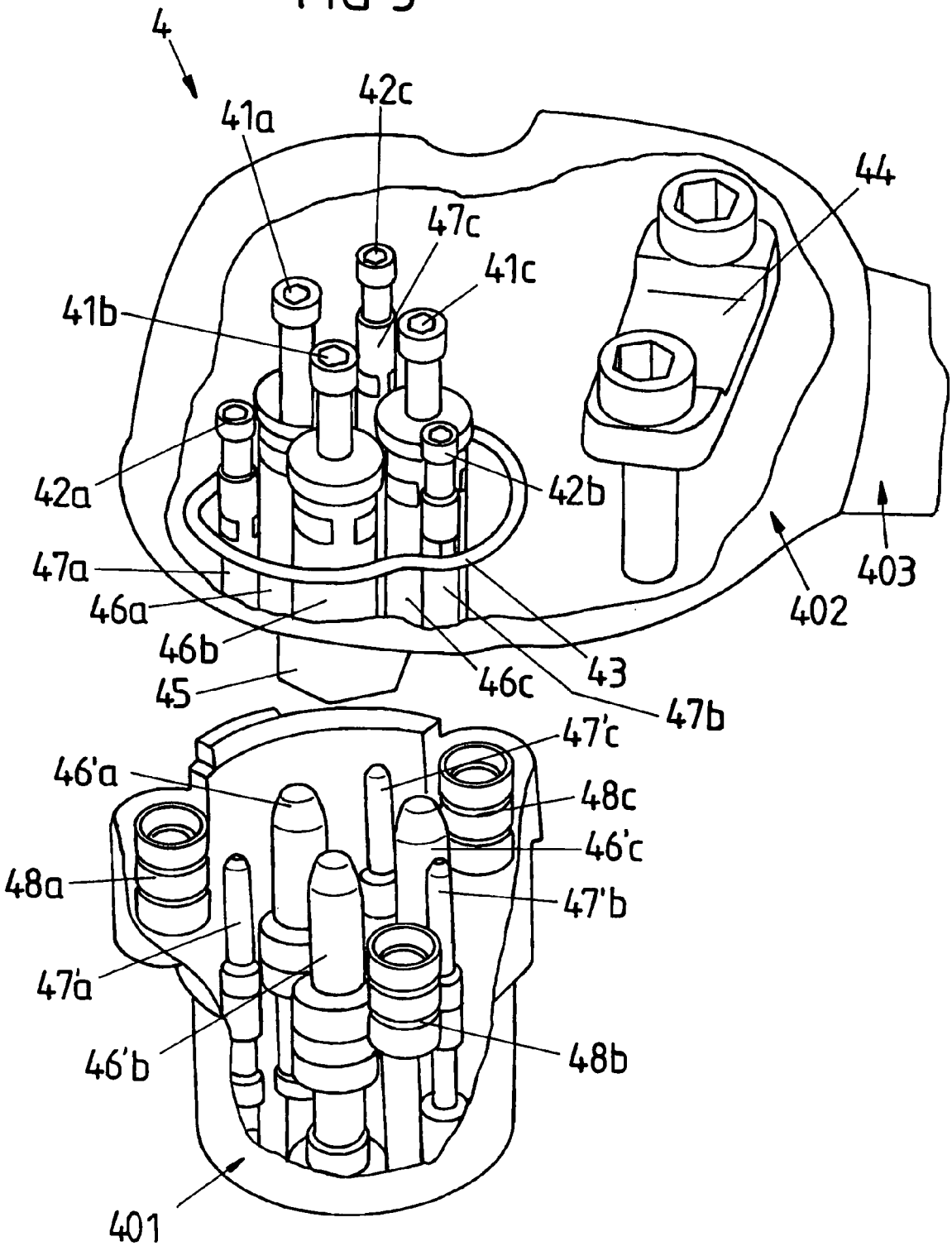
FIG. 5 shows a perspective partial sectional view of a further embodiment of the electrical terminal with an electric connector and a connector receptacle for connecting a supply line to the spotlight.

FIG. 5 shows a partial sectional view of a configuration of the electrical terminal 4, in which the electrical terminal 4 includes an electric connector 402, which is connected with the electric supply line 403, and a connector receptacle 401, which is arranged on the wall 151 of the function housing 15 of the middle part 12 on the spotlight housing 10. In this variant of the electrical terminal 4, the electric connector 402 is plugged into the connector receptacle 401 for making the electric connection, and the connector 402 and the connector receptacle 401 are rotated together and aligned. For this purpose, the connector receptacle 401 is releasable from the wall 151 of the function housing 15, is released for alignment and fastened again upon alignment of the electrical terminal 4, in order to fix the electrical terminal 4 in its aligned position.

From the connector receptacle 401 arranged on the function housing 15, an electric connection (not shown in FIG. 5) exists for instance to an ignitor enclosed in the function housing 15 or to other functional elements, so that via the electric connector 402 and the connector receptacle 401 an electric connection is provided between the supply line 403 and the function housing 15.

Figure 6:
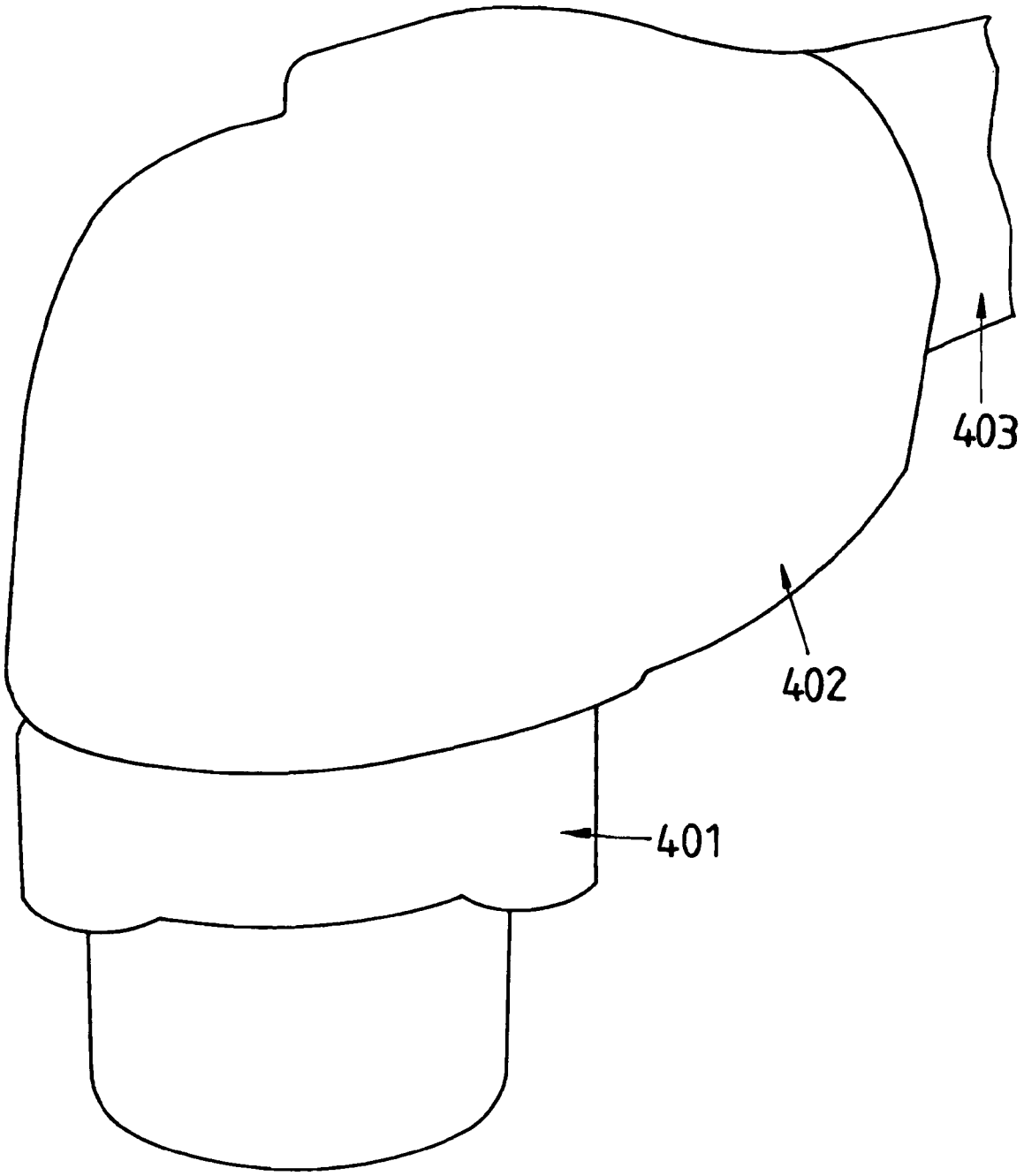
FIG. 6 shows a schematic view of the contour of the electrical terminal of FIG. 5 with the electric connector and the connector receptacle in the connected condition.

In FIG. 6, the electrical terminal 4 is schematically shown in a condition in which the connector 402 is plugged into the connector receptacle 401 and hence the connection between the electric supply line 403 and the function housing 15 is made.

The electrical terminal 4 consisting of the connector 402 and the connector receptacle 401 includes electric connecting pins 46'*a-c*, 47'*a-c* in the connector receptacle 401, which can be plugged into receptacles 46*a-c*, 47*a-c* on the connector 402, so that in the condition plugged in an electric contact exists each between the connecting pins 46'*a-c*, 47'*a-c* and the receptacles 46*a-c*, 47*a-c* and hence between the connector 402 and the connector receptacle 401.

The receptacles 46*a-c*, 47*a-c* each are connected with electric conductors (not shown in FIG. 5 for reasons of clarity), which extend from the receptacles 46*a-c*, 47*a-c* into the supply line 403 and serve to supply electricity to and activate the spotlight 1 in operation. Via contacts 41*a-c*, 42*a-c*, the individual electric conductors of the supply line 403 are connected with the receptacles 46*a-c*, 47*a-c* in the connector 402 for instance by means of a soldered or clamp connection. Six receptacles 46*a-c*, 47*a-c* on the connector 402 and six connecting pins 46'*a-c*, 47'*a-c* correspondingly insertable into the receptacles 46*a-c*, 47*a-c* are provided in the connector receptacle 401 and are utilized for connecting the electric supply line 403 with the spotlight 1.

The three connecting pins 46'*a-c* and 47'*a-c*, respectively, of the connector receptacle 401 each are arranged on end points of an imaginary equilateral triangle, wherein the two equilateral triangles formed by the connecting pins 46'*a-c* and 47'*a-c*, respectively, are arranged concentrically with respect to each other. The receptacles 46*a-c*, 47*a-c* receiving the connecting pins 46'*a-c*, 47'*a-c* in the connector 402 correspondingly are arranged such that when plugging in the connector 402 into the connector receptacle 401, the connecting pins 46'*a-c*, 47'*a-c* slide into the receptacles 46*a-c*, 47*a-c*.

In the embodiment of the electrical terminal 4 as shown in FIG. 5, all six receptacles 46*a-c*, 47*a-c* and connecting pins 46'*a-c*, 47'*a-c* are utilized for supplying electricity to and controlling the spotlight 1. The connector 402 can be plugged into the connector receptacle 401 in only one plug-in position, and the connector receptacle 401 is rotatably arranged on the wall 151 and alignable relative to the same. For locking the connector 402 in the connector receptacle 401, threaded sockets 48*a-c* are arranged on the connector receptacle 401, in which engage screws which for this purpose extend through openings (not shown in FIG. 5) provided on the connector 402. In this way, the wall 151 can clampingly be retained between the connector receptacle 401 and the connector 402 by means of screw connections, in order to on the one hand fix the electrical terminal 4 in its alignment and on the other hand secure the connection between the connector 402 and the connector receptacle 401.

To define the plug-in position of the connector 402 into the connector receptacle 401, the connector 402 and the connector receptacle 401 have a mechanical coding, which in a mechanical way ensures that the connector 402 can be plugged into the connector receptacle 401 in only one plug-in position. Embodiments of such coding will subsequently be described in detail with reference to FIGS. 8 to 11.

To achieve a mechanically stable connection between the connector 402 and the connector receptacle 401, a hexagonal connecting element 45 is provided on the connector 402, which extends from the connector 402 in the direction of the connector receptacle 401 and when plugging the connector 402 vertically into the connector receptacle 401 can accurately be inserted between the connecting pins 46'*a-c*, 47'*a-c*.

The electric connector 402 furthermore includes a locking device 44, by means of which the electric supply line 403 can mechanically be locked in the connector 402. Due to the mechanical connection of the electric supply line 403 with the electric connector 402, strain is relieved from the conductors (not shown in FIG. 5) provided in the supply line 403 and connected with the contacts 41*a-c*, 42*a-c* in the electric connector 402, so that a tensile force acting on the supply line is mechanically transmitted to the housing of the connector 402 and does not act on the receptacles 46*a-c*, 47*a-c*.

On the bottom surface of the connector 402 a seal 43 is provided, which comes to lie between the connector 402 and the connector receptacle 401, when the connector 402 is plugged into the connector receptacle 401, and prevents moisture from getting into the region of the electric connecting pins 46'*a-c*, 47'*a-c* and their receptacles 46*a-c*, 47*a-c*.

In the configuration of the electrical terminal 4 as shown in FIG. 5—when no mechanical coding is provided—plugging the connector 402 into the connector receptacle 401 in principle is possible in three different alignments rotated with respect to each other by 120°, since the connecting pins 46'*a-c*, 47'*a-c* of the connector receptacle 401 and the receptacles 46*a-c*, 47*a-c* of the connector 402 are arranged on the corner points of fictitious equilateral triangles. This can be utilized to define three plug-in positions of the connector 402 into the connector receptacle 401 without an additional mechanical coding and in this way obtain an alignability of the electrical terminal 4, in which the connector receptacle 401 is firmly arranged on the wall 151 and for alignment the connector 402 merely is rotated and can be plugged into the connector receptacle 401 in another plug-in position. To provide for the same, the electric conductors and the corresponding receptacles 46*a-c*, 47*a-c* of the connector 402 and the connecting pins 46'*a-c*, 47'*a-c* of the connector receptacle 401 must, however, be configured redundantly, in order to configure the different plug-in positions electrically the same. For this purpose, in the embodiment as shown in FIG. 5, one of the connecting pins 46'*a-c* each for instance can form a pair with one of the connecting pins 47'*a-c*, which can be plugged into a corresponding pair of two receptacles 46*a-c*, 47*a-c*. Three identically formed redundant pairs thus define three electrically equally acting plug-in positions, in which the connector 402 can be plugged into the connector receptacle 401. In contrast to the above-described configuration, it is not possible in this variant to use all six conductors at the same time for supplying electricity to the spotlight 1, but merely one pair of two connecting pins 46'*a-c*, 47'*a-c*.

Figure 7:
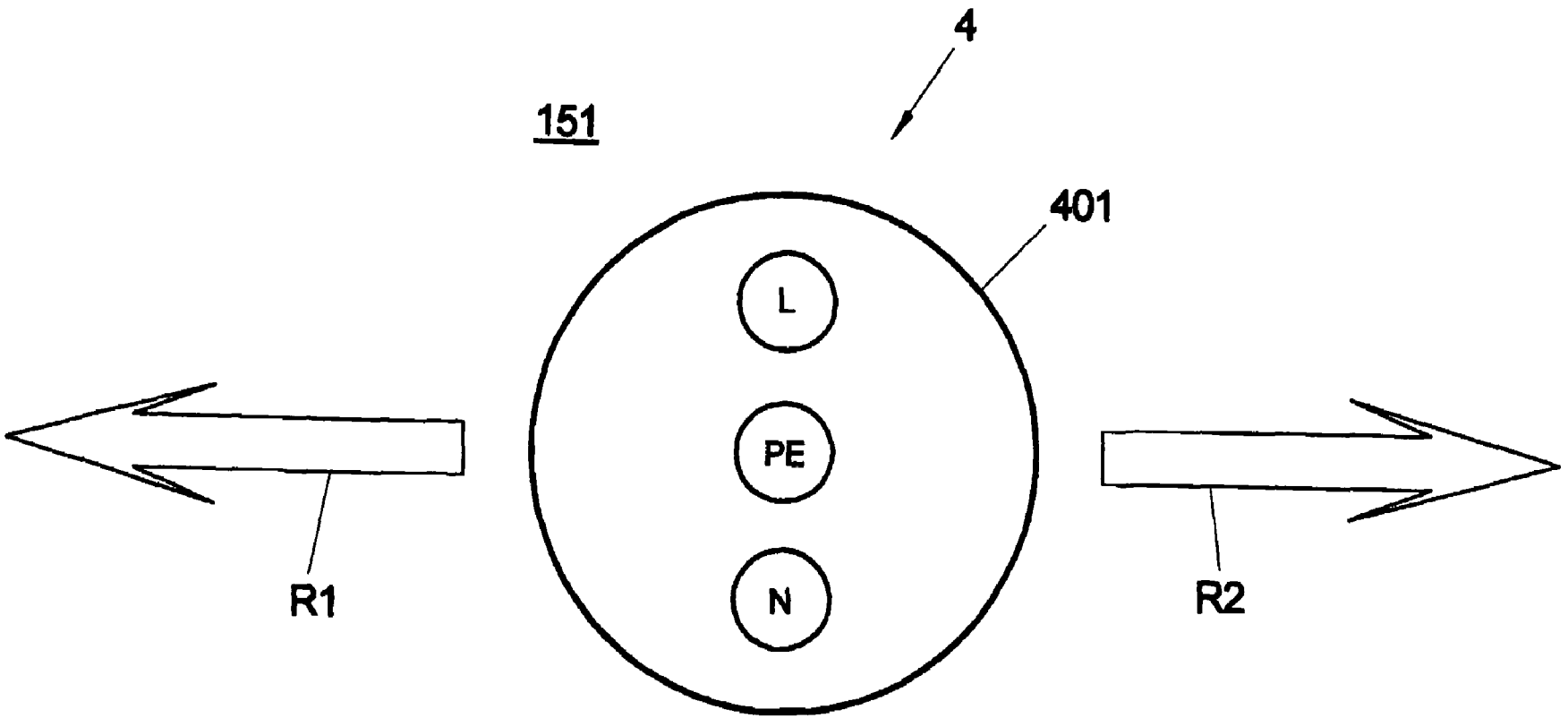
FIG. 7 shows a schematic view of a three-pole connector receptacle with three connecting pins arranged vertical to each other.

FIG. 7 shows a schematic representation of an embodiment of the electrical terminal 4, in which the connector receptacle 401 is firmly connected with the wall 151 of the spotlight housing 10 and the connector 402 can be inserted in the connector receptacle 401 in two plug-in positions rotated with respect to each other by 180°, so that the supply line 403 (see FIGS. 1 to 3) connected with the connector 402 can be routed away from the electrical terminal 4 in two opposite directions R1, R2. In this embodiment, three connecting pins L, PE and N are arranged in the connector receptacle 402 vertical to each other, with the connecting pin PE being associated to a protective conductor and being arranged centrally between the two remaining connecting pins L, N. In this way, it is possible to insert the connector 402 rotated by 180° into the connector receptacle 401 firmly connected with the wall 151 and accordingly provide for use of the spotlight 1 in a stand position and in a rig position, in which the supply line 403 is guided in a first direction R1 or in a second direction R2 from the electrical terminal 4 towards the stand or the rig.

The embodiment of the electrical terminal 4 as shown in FIG. 7 without an additional mechanical coding (or with a coding defining two opposite plug-in positions) is suitable for tungsten spotlights, as due to the use of an incandescent filament it is admissible to exchange the neutral conductor (connecting pin N) for the phase conductor (connecting pin P), which is not possible in a daylight lamphead. This embodiment provides for a particularly simple and, if necessary, also very small configuration of the connector receptacle 401 and hence of the electrical terminal 4.

In FIGS. 8, 9, 10A, 10B, 11A, 11B two different embodiments of an electrical terminal 4 with a connector receptacle 401 are shown, in which a mechanical coding is formed by means of a series of hexagonal elevations and indentations 411-416, in each of which an electric connecting pin 46'*a-c*, 47'*a-c* is inserted for electrically connecting the connector receptacle 401 with the connector 402. As far as expedient, components having the same function subsequently are provided with the same reference numerals.

Figure 8:
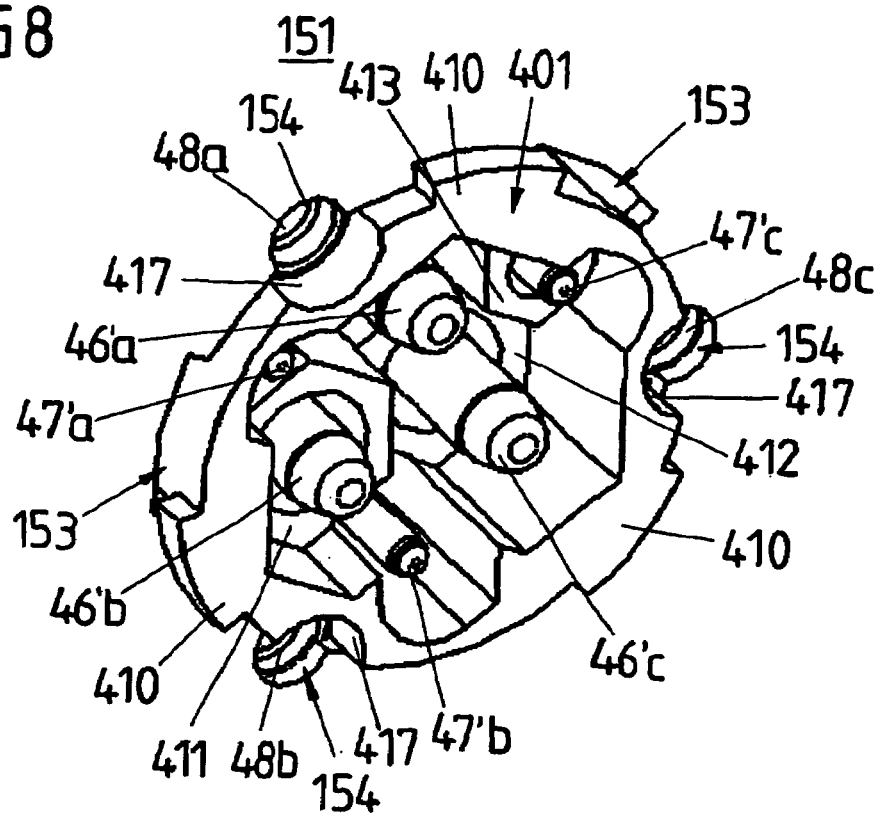
FIG. 8 shows a perspective view of an embodiment of the connector receptacle with a mechanical coding for definition of the plug-in position of the connector into the connector receptacle.
Figure 10A:
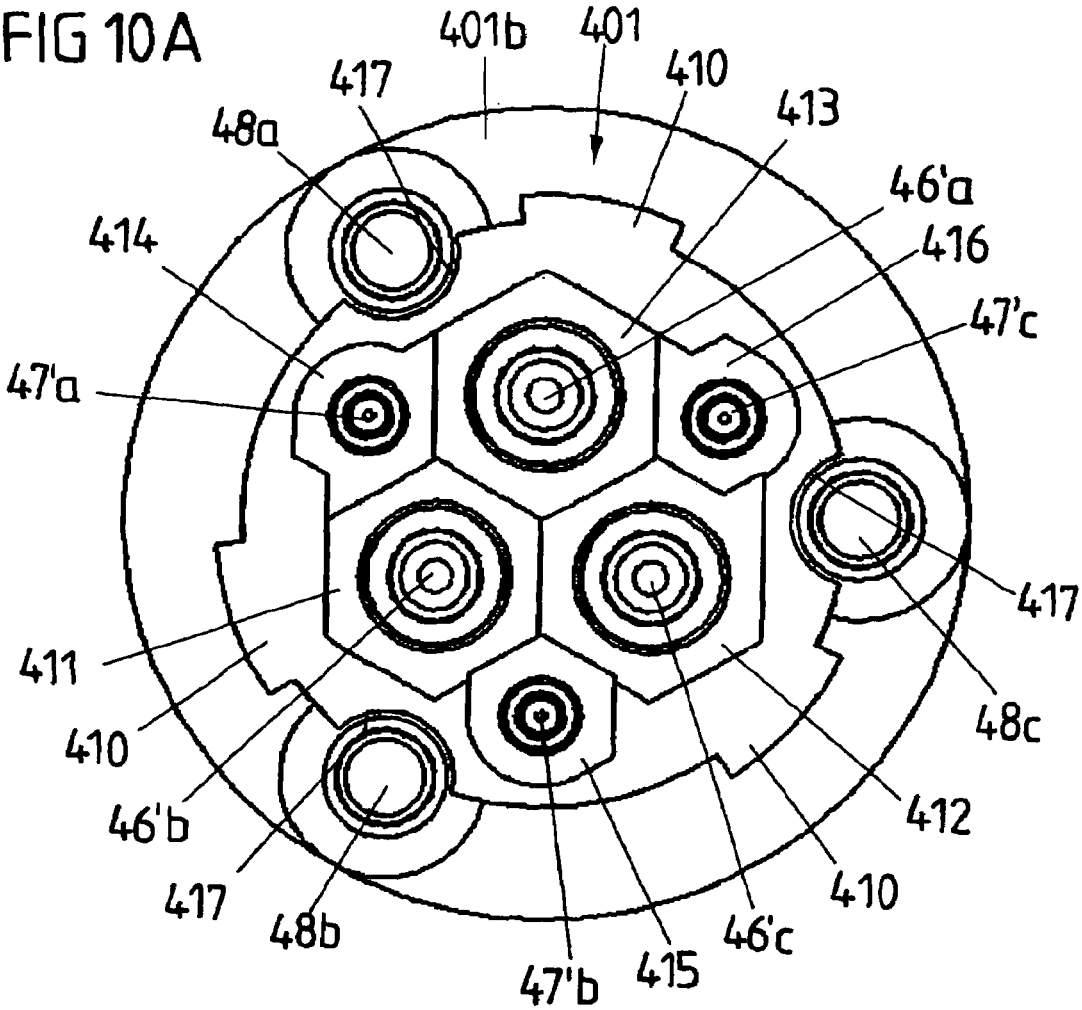
FIG. 10A shows a schematic top view of the connector receptacle of FIG. 8.

A first embodiment of the connector receptacle 401 with coding is shown in FIG. 8 in a perspective view of the connector receptacle 401 on the wall 151 of the spotlight housing 10. FIG. 10A shows a top view of the connector receptacle 401 of FIG. 8, and FIG. 10B shows the contour of the opening 152 in the wall 151 of the spotlight housing 10, in which the connector receptacle 401 is retained.

The mechanical coding of the connector receptacle 401 is formed by substantially hexagonal elevations and indentations 411-416, which are molded into the connector receptacle 401 and effect that a connector 402 (not shown in FIG. 8 and FIGS. 10A, 10B) can be plugged into the connector receptacle 401 merely in one plug-in position, i.e. in one alignment. Due to the elevations and indentations 411-416, a nonuniform, stepped surface of the connector receptacle 401 is formed, which thus is coded, so that it is in merely one alignment of the connector 402 that corresponding elevations and indentations provided on the connector 402 can accurately be inserted between the elevations and indentations 411-416 of the connector receptacle 401. For this purpose, the elevations and indentations of the connector 402 are formed such that to an elevation 411, 413 of the connector receptacle 401 an indentation of the connector 402 is associated and, vice versa, to an indentation 412, 413, 414, 415 of the connector receptacle 401 an elevation of the connector 402 is associated. Only when the connector 402 is correspondingly positioned and aligned relative to the connector receptacle 401, can the connector 402 be inserted into the connector receptacle 401, wherein the connecting pins 46'a-c, 47'a-c slide into the receptacles 46a-c, 47a-c and make the electrical contact between the connector receptacle 401 and the connector 402.

Figure 10B:
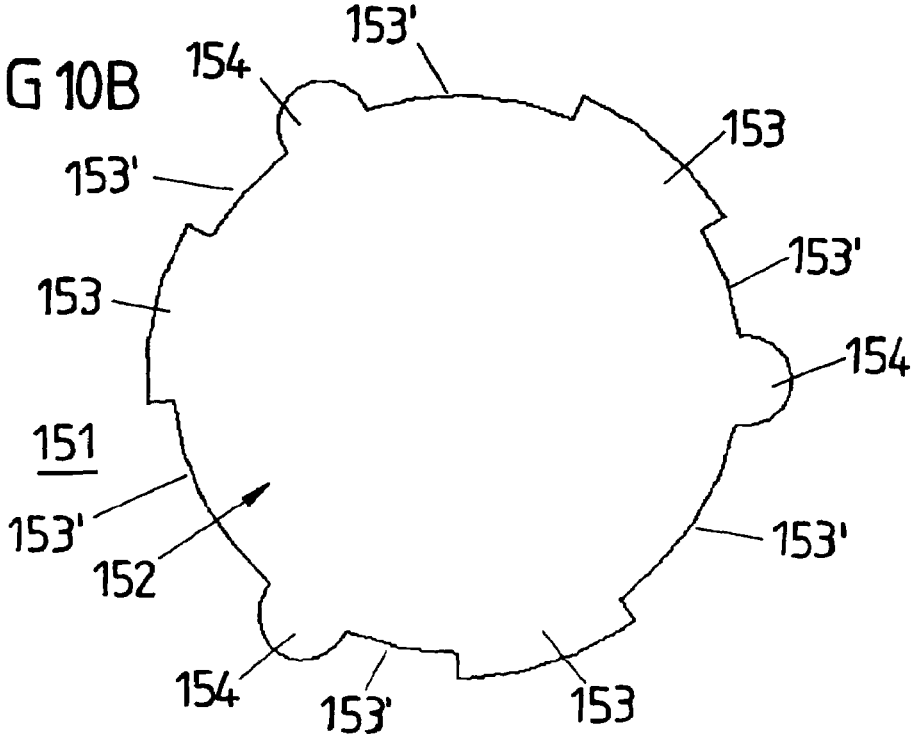
FIG. 10B shows a schematic view of the contour of the opening in the spotlight housing for accommodating the connector receptacle of FIG. 8.

In the embodiment shown in FIG. 8 and FIGS. 10A and 10B, the connector 402 thus can be inserted in the connector receptacle 401 merely in one position. For aligning the electrical terminal 4, the connector receptacle 401 and the connector 402 together are rotated relative to the wall 151 and subsequently are attached to the wall 151 in the desired position.

In its edge portion, the connector receptacle 401 includes projections 410, which for arrangement of the connector receptacle 401 on the wall 151 are guided from the interior of the spotlight housing 10 through recesses 153 of the opening 152 in the wall 151 (see FIG. 10B), so that the bearing plate 401b of the connector receptacle 401 (see FIG. 10A) comes to rest against the rear of the wall 151. Subsequently, the connector receptacle 401 is rotated relative to the wall 151 such that recesses 417 in the edge portion of the connector receptacle 401 get into the region of recesses 154 in the contour of the opening 152 of the wall 151, as shown in FIG. 8, so that the projections 410 retainingly enclose webs 153' in the edge portion of the opening 152.

In the position of the connector receptacle 401 shown in FIG. 8, screws can be screwed from outside through the recesses 417, 154 into the threaded sockets 48a-48c in the bearing plate 401b, in order to fix the connector receptacle 401 on the wall 151. By means of the screws screwed into the threaded sockets 48a-48c in the bearing plate 401b and extending through the recesses 417, 154, the electrical terminal 4 on the one hand is fixed on the wall 151, and on the other hand the connection between the connector receptacle 401 and the connector 402 is secured by the screws extending through openings in the connector 402.

In the embodiment shown in FIG. 8 and FIGS. 10A and 10B, three different positions of the connector receptacle 401, rotated with respect to each other by 120°, are possible relative to the wall 151. The alignment of the electrical terminal 4 can be changed in that the screws are removed from the threaded sockets 48a-48c, the electrical terminal 4 is rotated in the desired way, and the screws are screwed into the threaded sockets 48a-48c for fixing the electrical terminal in its changed position.

Figure 9:
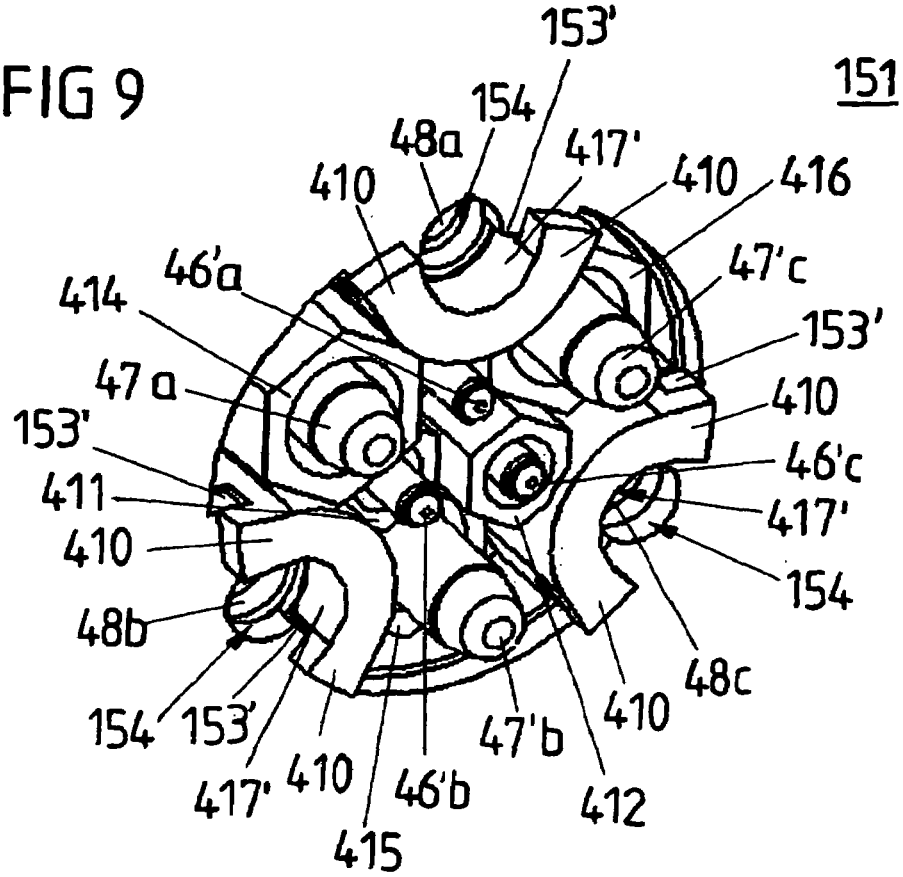
FIG. 9 shows a perspective view of a further embodiment of the connector receptacle with a mechanical coding for definition of the plug-in position of the connector into the connector receptacle.
Figure 11A:
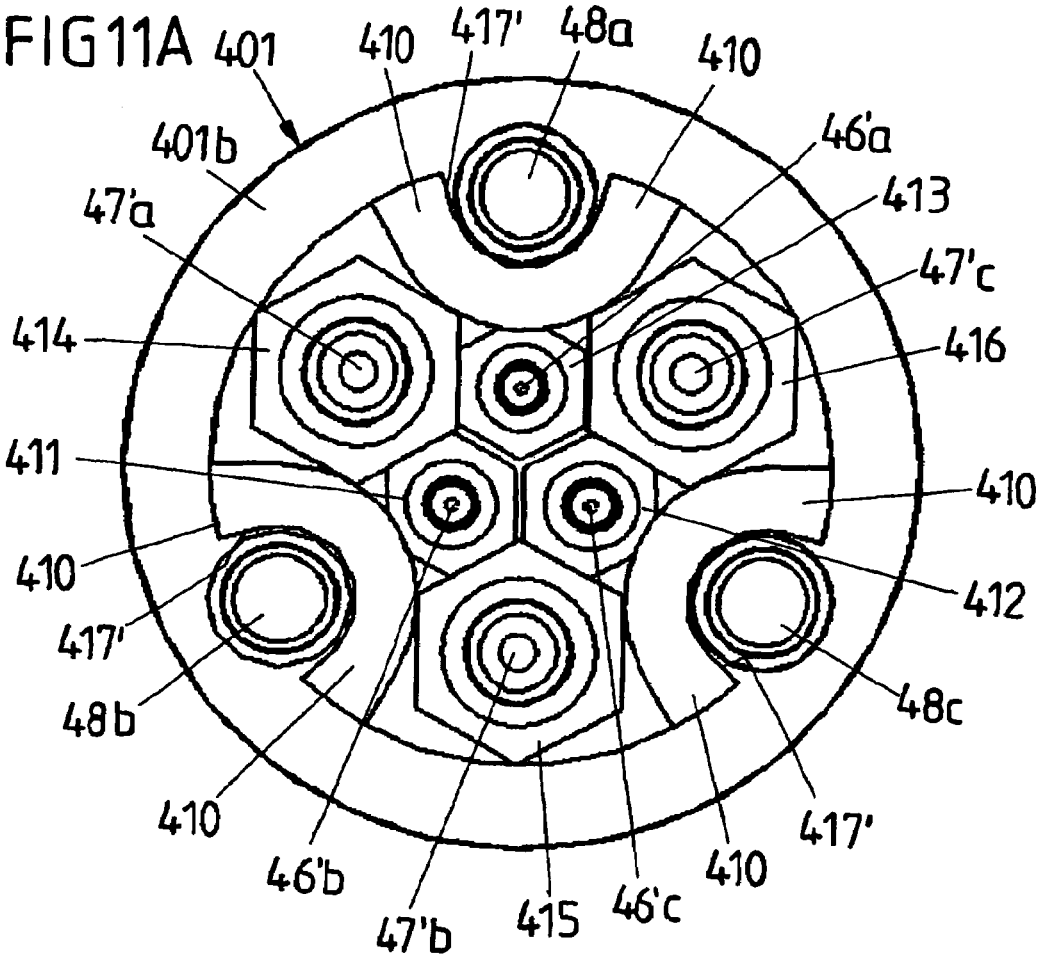
FIG. 11A shows a schematic top view of the connector receptacle of FIG. 9.
Figure 11B:
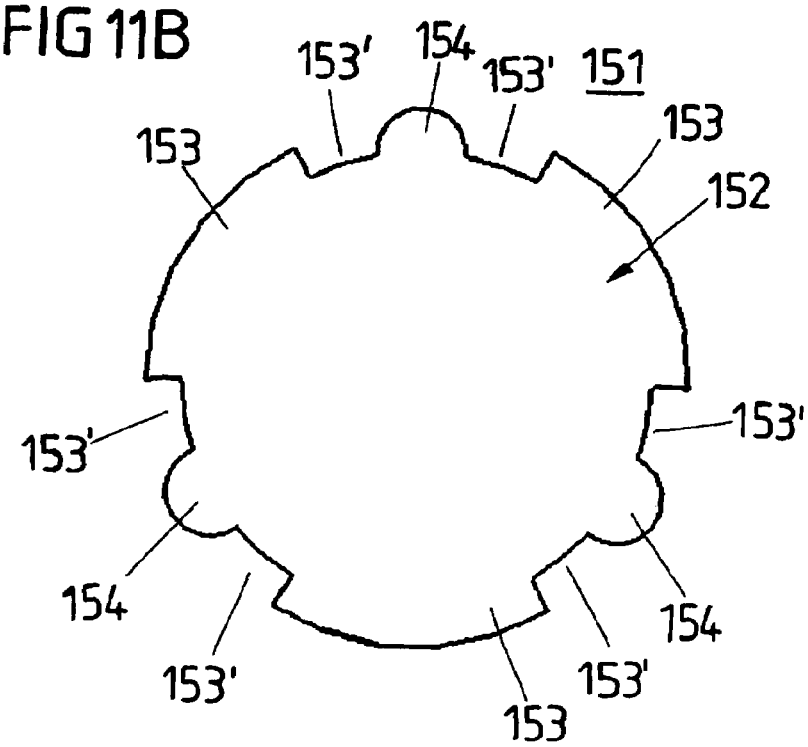
FIG. 11B shows a schematic view of the contour of the opening in the spotlight housing for accommodating the connector receptacle of FIG. 9.

A second embodiment of the connector receptacle 401 with a coding is shown in FIG. 9 in a perspective view and in FIGS. 11A and 11B in a top view of the connector receptacle 402 and in a view of the contour of the opening 152 in the wall 151. Similar to the embodiment of FIG. 8 and FIGS. 10A and 10B, there are used elevations and indentations 411-416 in the form of hexagons, which define a stepped surface of the connector receptacle 401 and allow a corresponding connector 402 to be plugged in merely in a single plug-in position.

In the embodiment of FIG. 9 and FIGS. 11A and 11B, as a modification of the embodiment of FIG. 8 and FIGS. 10A and 10B, the connecting pins 46'a-c located inside have a smaller diameter than the outside connecting pins 47'a-c, without substantially functionally changing the construction of the connector receptacle 401 and of the associated connector 402.

The connector receptacle 401 includes projections 410, which for arrangement of the connector receptacle 401 in the opening 152 are guided from the interior of the spotlight housing 10 through recesses 153 of the opening 152, so that the bearing plate 401b of the connector receptacle 401 comes to rest against the rear of the wall 151. The projections 410 are formed in terminal regions of a substantially U-shaped raised mounting region 417' extending from the bearing plate 401b through the opening 152 to the outside, which for mounting the connector receptacle 401 to the wall 151 in the vicinity of recesses 154 is rotated in the contour of the opening 152, so that the projections 410, as shown in FIG. 9, enclose the edge portion of the opening 152 in the vicinity of webs 153', which laterally adjoin the recesses 154 in the contour, and retain the connector receptacle 401 in the opening 152.

For fixing the connector receptacle 401 on the wall 151, screws are screwed into the threaded socket 48a-48c of the bearing plate 401b, which extend through the mounting region 417' and the recesses 154 and in this way fix the connector receptacle 401 together with the connector 402 plugged into the connector receptacle 401 in its position and location on the wall 151. For newly aligning the electrical terminal 4, the screws are removed from the threaded sockets 48a-48c, the connector receptacle 401 is rotated together with the connector 402, and the electrical terminal 4 is fixed in the new position by screwing the screws into the threaded sockets 48a-48c.

Similar to the embodiment of FIG. 8 and FIGS. 10A and 10B, three different positions of the electrical terminal 4 on the wall 151 are provided in the embodiment of FIG. 9 and FIGS. 11A and 11B, which each are rotated with respect to each other by 120°.

The connector receptacles 401 as shown in FIGS. 8, 9, 10A, 10B, 11A, 11B illustrate different orders of magnitude of possibilities for a mechanical coding of the connector receptacle by means of a series of hexagons, in which electric connecting pins 46'a-c, 47'a-c are inserted for making an electric contact with the connector 402 to be plugged into the connector receptacle 401 (not shown in FIGS. 8, 9, 10A, 10B, 11A, 11B). The hexagons arranged in series are recessed differently into the surface of the connector receptacle 401, so that a connector 402 can be plugged into the connector receptacle and can be contacted electrically only in one specified direction. The embodiment as shown in FIGS. 9, 11A, 11B represents a space-optimized configuration of the embodiment of FIGS. 8, 10A, 10B in terms of the arrangement of the hexagonal elevations and indentations 411-416.

Completely different embodiments of the spotlight 1 using the idea underlying the invention are conceivable. Here, it is essential that an alignable electrical terminal 4 is provided, which can be rotated and aligned such that the routing of the supply line 403 can selectively be matched to the position and attachment of the spotlight 1.

The invention claimed is:

1. A spotlight for illumination in film, studio, event or theatre environments, with an electrical terminal for connecting the spotlight to a supply line for supplying electricity to the spotlight, wherein the electrical terminal is rotatably mounted on the spotlight so as to connect the spotlight to the supply line, wherein the position of the electrical terminal can be matched in dependence on an arrangement of the spotlight to supply the electric supply line to the spotlight from different directions.

2. The spotlight according to claim 1, wherein the electrical terminal is arranged on a spotlight housing of the spotlight.

3. The spotlight according to claim 2, wherein the electrical terminal is arranged on a wall of a function housing of the spotlight housing, which contains functional elements.

4. The spotlight according to claim 3, wherein the electrical terminal can be rotated about an axis of rotation.

5. The spotlight according to claim 1, wherein for mounting the spotlight on a stand, the electrical terminal can be aligned in a first direction, and for mounting the spotlight on a rig, the electrical terminal can be aligned in a second direction different from the first direction.

6. The spotlight according to claim 1, wherein the electrical terminal can be fixed in its aligned position on the spotlight by means of a latching, clamp or screw connection.

7. The spotlight according to claim 6, wherein a curved oblong hole or a plurality of mounting points are arranged on the spotlight for receiving a screw connection for fixing the electrical terminal in different positions.

8. The spotlight according to claim 1, wherein the electrical terminal includes an electric connector, which is connected to the electric supply line, and a connector receptacle, which is arranged on the spotlight housing, wherein the electric connector can be plugged into the connector receptacle for connection of the supply line.

9. The spotlight according to claim 8, wherein the connector receptacle is rotatably mounted on the spotlight housing.

10. The spotlight according to claim 8, wherein the electric connector and the connector receptacle include a mechanical coding, which ensures that the connector can be plugged into the connector receptacle in a defined alignment.

11. The spotlight according to claim 8, wherein the electric connector can be plugged into the connector receptacle in different positions rotated with respect to the connector receptacle about an axis of rotation of said electrical terminal.

12. The spotlight according to claim 8, wherein the electrical terminal includes a safety switching device, which only enables the electrical terminal when the connector is connected with the connector receptacle.

13. The spotlight according to claim 1, wherein the spotlight housing of the spotlight includes a front part, a middle part and a rear part for accommodating light-generating and light-forming components of the spotlight.

14. The spotlight according to claim 13, wherein the spotlight housing is of the modular type, wherein the front part, the middle part and the rear part are connected with each other by at least one connecting means acting in an axial direction of the spotlight, and by releasing the connecting means the front part, the middle part and the rear part of the spotlight housing can be demounted.

15. The spotlight according to claim 14, wherein the connecting means comprises axially aligned screw connections.

16. The spotlight according to claim 15, wherein proceeding from the rear part, the axially extending screw connections engage through the middle part into the front part.

17. The spotlight according to claim 15, wherein self-cutting threads are provided in the middle part for accommodating the screw connections.

18. The spotlight according to claim 13, wherein the front part and the rear part constitute aluminum castings, and the middle part at least partly constitutes an aluminum extruded section.

19. The spotlight according to claim 13, wherein the rear part, the middle part and/or the front part of the spotlight housing are replaceable for configuration of the light-generating and light-forming components enclosed in the spotlight housing.

20. The spotlight according to claim 13, wherein the spotlight housing comprises an upper lamp housing for accommodating a lamp and a reflector and a lower function housing for accommodating functional elements of the spotlight, wherein the electrical terminal is arranged on the function housing.

21. The spotlight according to claim 20, wherein the upper lamp housing and the lower function housing are connected with each other by the front part and the rear part.

22. The spotlight according to claim 21, wherein the front part and/or the rear part are formed in one piece.

23. The spotlight according to claim 20, wherein the front part and/or the rear part are formed in two pieces with an upper part and a lower part, and the upper lamp housing and the lower function housing can pluggably be connected with each other by means of a plug-in connection.

24. The spotlight according to claim 20, wherein the upper lamp housing and the lower function housing are replaceable independent of each other.

* * * * *